US007722438B1

(12) United States Patent
Bevard et al.

(10) Patent No.: US 7,722,438 B1
(45) Date of Patent: May 25, 2010

(54) AIR BLOW FUNCTIONALITY FOR DISC SANDER

(75) Inventors: Doug Bevard, Delaware, OH (US); Tim Palmer, Bellefontaine, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/834,250

(22) Filed: Aug. 6, 2007

(51) Int. Cl.
*B24B 1/00* (2006.01)
*B24B 23/00* (2006.01)

(52) U.S. Cl. ..... 451/28; 451/294; 451/359

(58) Field of Classification Search ..... 451/358, 451/359, 295, 294, 28
See application file for complete search history.

(56) References Cited

U.S. PATENT DOCUMENTS 1,881,129 A * 10/1932 Peek et al. ..... 15/29
2,077,693 A * 4/1937 Herrero ..... 451/358
4,296,572 A 10/1981 Quintana
4,355,487 A * 10/1982 Maier et al. ..... 451/357
4,355,489 A * 10/1982 Heyer et al. ..... 451/532
4,733,120 A * 3/1988 Kawabe ..... 310/268
4,773,120 A * 9/1988 Wang ..... 15/344
4,959,928 A 10/1990 Hartwig, Sr.
5,154,021 A 10/1992 Bombardier et al.
5,651,727 A * 7/1997 Weinstein et al. ..... 451/344
5,716,262 A 2/1998 Kiba
6,190,245 B1 2/2001 Heidelberger et al.
6,447,387 B1 9/2002 Tseng
7,189,184 B2 * 3/2007 Oshiumi et al. ..... 477/46

* cited by examiner

*Primary Examiner*—Robert Rose
(74) *Attorney, Agent, or Firm*—Rankin, Hill & Clark LLP

(57) ABSTRACT

A pneumatic tool with an air blow device. The pneumatic tool, a dual action (DA) sander, includes a nozzle and air blow valve. Compressed air is provided via a DA supply line and an air blow supply line to independently power the DA sander and the air blow device, respectively. The DA sander has an actuator for activating a tool piece including a mounting disc and sandpaper. The air blow device is activated by depressing an actuating button on the air blow valve to open the air blow valve. Layout of the tool piece and the air blow device provide for independent operation of the tool piece and the air blow device.

13 Claims, 3 Drawing Sheets

AIR BLOW FUNCTIONALITY FOR DISC SANDER

BACKGROUND OF THE INVENTION

1. Field of the Invention

The present invention is directed toward an air blow device for a dual action disc sander.

2. Description of Related Art

In modern manufacturing plants and vehicle repair facilities, it is common to have pneumatic tools for performing manufacturing/repair related tasks. These pneumatic tools use compressed air as an energy source for operation. The compressed air is supplied by a main air supply line that provides large volumes of air at a set pressure.

The pneumatic tool may be, for example, a drill for drilling holes, a saw for cutting materials, or a dual action (DA) disc sander for sanding/polishing a surface. The pneumatic tools are lightweight and traditionally operate at high speed. By operating at high speed, the pneumatic tool can quickly complete the required manufacturing/repair task.

Traditionally, a worker is faced with multiple tasks that must be performed at the worker's workstation. These tasks may or may not be related. For example, the worker may need to drill a hole in an object and then tighten a fastener that extends through the recently drilled hole. Alternatively, the tasks may be somewhat diverse in nature and only related in that the first task precipitated the second task.

For example, the worker may use the DA sander to sand/polish a portion of a painted surface (hereinafter "work area") of a vehicle (hereinafter "workpiece"). Unfortunately, the DA sander creates airborne dust and/or debris. As such, the dust/debris may settle in/on an area of the vehicle that is not adjacent to the workpiece (hereinafter "non-work area"). Further, the non-work area where the dust/debris settles may be a somewhat confined space with reduced accessibility.

Known in the art are pneumatic tools that cut, drill, or sand (hereinafter "work") with a blade, drill bit, or mounting disc with sandpaper (hereinafter "tool piece"), that also expel pressurized air to clear dust or debris from around the work area. Such known pneumatic tools expel the pressurized air through the nozzle any time that the tool piece is active, so as to remove dust/debris from the around the work area as the dust/debris is created. While these known pneumatic tools are effective in removing dust/debris from the workpiece during operation of the tool piece, the tools are ineffective in removing dust/debris from the non-work areas (i.e., areas remote from the work area).

Traditionally, when dust/debris settles onto the non-work area, the worker could disconnect the pneumatic tool from the main air supply line and attach an air blow gun to remove the dust/debris from the non-work area. However, disconnecting the tool and connecting the air blow gun takes additional time and effort. In a manufacturing/repair environment, the worker may opt to not remove the dust/debris from the non-work area to avoid suffering from the lost productivity attributed to changing from the tool to the air blow gun. Alternatively, dedicated air blow guns may be used to remove the dust/debris from the non-work area. However, such an arrangement is expensive and requires additional compressed air connections and space that may not be available in the manufacturing/repair environment.

Unfortunately, when dust/debris is allowed to remain in the non-work area, problems on the downstream manufacturing line or in the repair facility may be encountered. For example, the dust/debris may later become airborne again and settle in a still wet paint area of the vehicle, resulting in an appearance defect. Alternatively, the dust/debris may become dislodged during some other subsequent operation during which dust/debris is not tolerated (e.g. during final assembly) or after the vehicle is delivered to the customer.

Therefore, there exists a need in the art for an apparatus and method to permit a worker to operate an air blow device without operating the tool piece of the tool.

SUMMARY OF THE INVENTION

The present invention is directed toward an apparatus and method for a pneumatic tool. In particular, the present invention includes a tool piece for engaging a workpiece and an air blow device with a nozzle on the pneumatic tool for displacing dust/debris from the workpiece.

More specifically, the nozzle displaces dust/debris that was created by the tool piece or otherwise, and the air blow device is operated independent of the tool piece.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
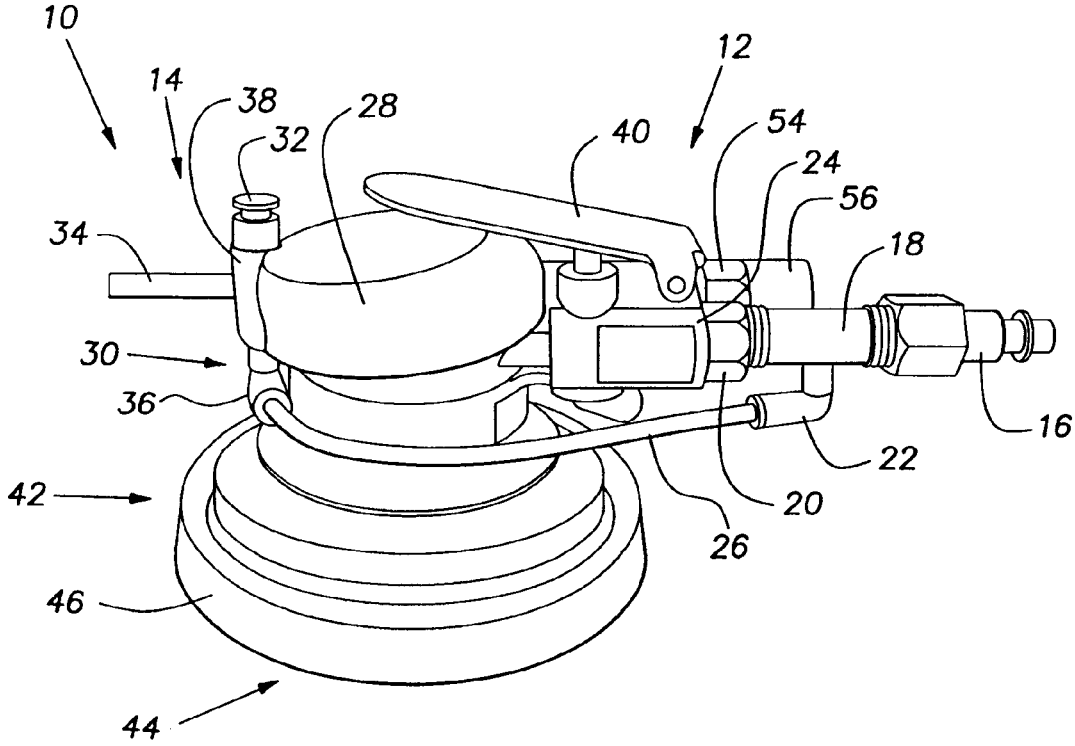
FIG. 1 is a perspective view of a disc sander according to the present invention.
Figure 2:
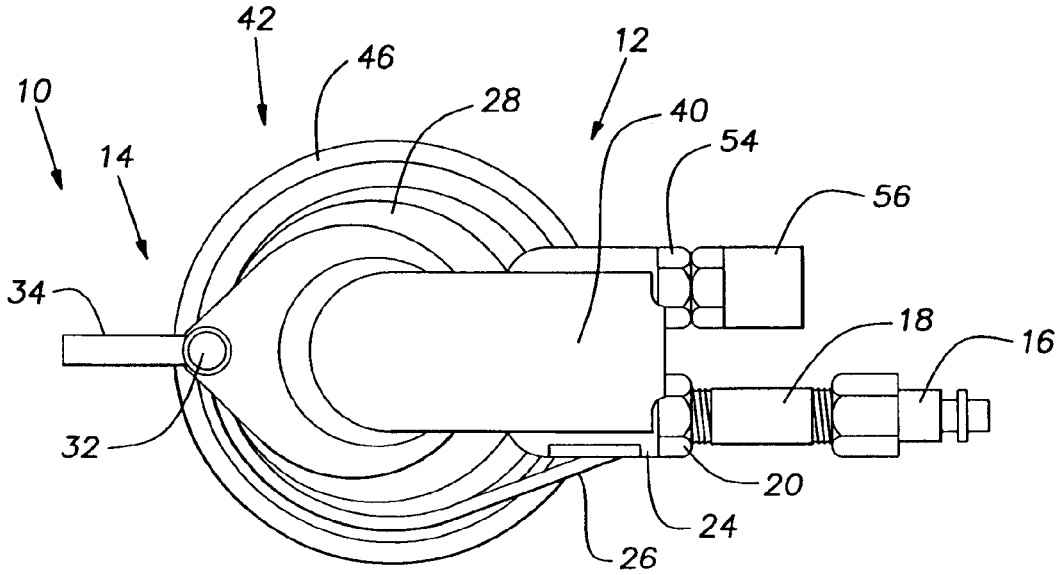
FIG. 2 is a top plan view of the disc sander of FIG. 1.

With reference to FIGS. 1 and 2, a pneumatic tool 10 according to the present invention includes a dual action (DA) sander 12 with an air blow device 14. In addition, the pneumatic tool 10 includes a main inlet 16, and a manifold 18 that is fluidly connected to a DA inlet 20 and an air blow inlet 22. The DA inlet 20 is connected to a DA supply line 24. The air blow inlet 22 is connected to an air blow supply line 26 that travels near a housing 28 of the DA sander 12. The air blow supply line 26 terminates at an air blow valve 30, having an actuating button 32, and the air blow valve 30 is fluidly connected to a nozzle 34. The air blow valve 30 includes a first section 36 and a second section 38.

Figure 3:
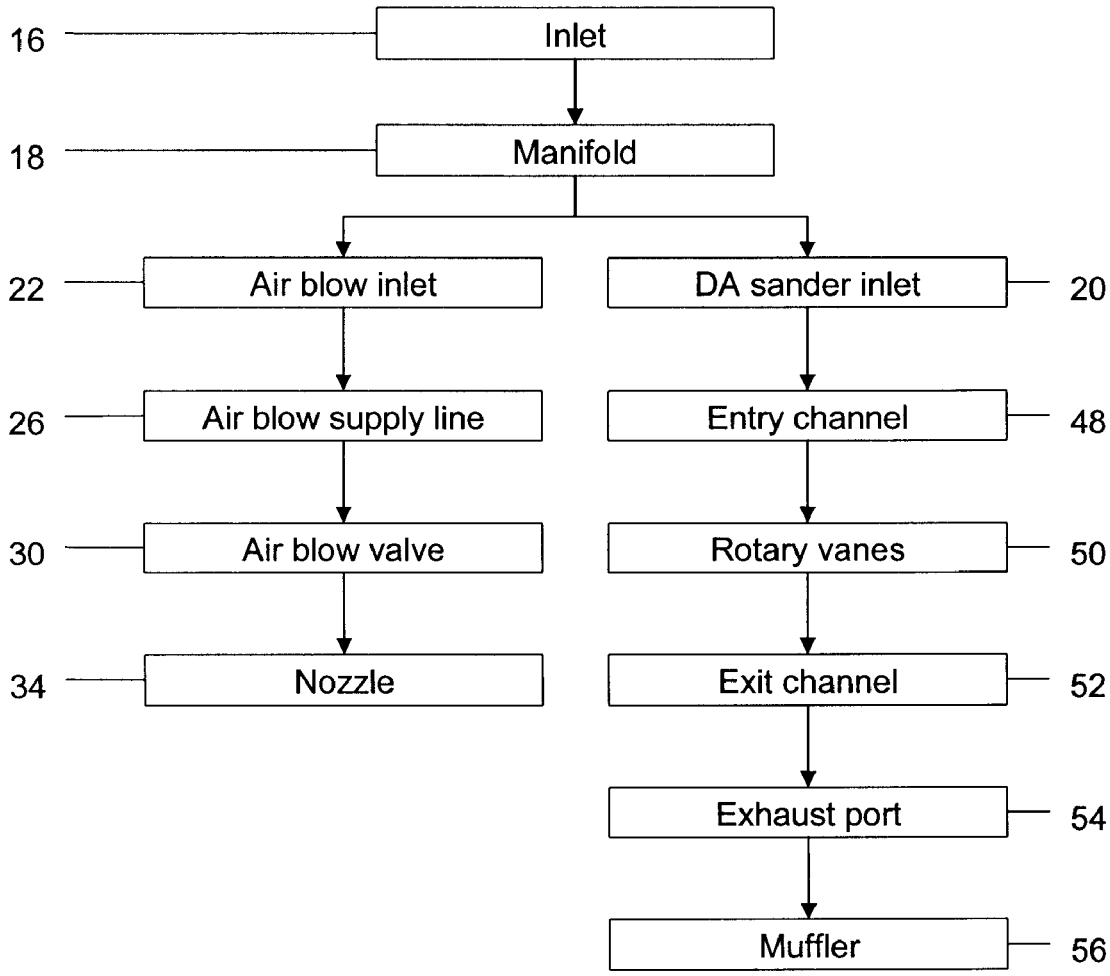
FIG. 3 is a pneumatic circuit of the present invention.

On top of the DA sander 12 is an actuator 40 and on bottom of the DA sander 12 is a tool piece 42 with sandpaper 44 and a related mounting disc 46. As shown in FIG. 3, an entry channel 48 is fluidly connected to a rotary air vane 50. The rotary air vane 50 is also fluidly connected to an exit channel 52. The entry channel 48, rotary air vane 50, and exit channel 52 are disposed inside of the housing 28. On back of the DA sander 12 is an exhaust port 54 with a muffler 56.

As mentioned hereinbefore, the area that the tool piece 42 of the DA sander 12 engages on the workpiece to sand/polish is referred to as a work area (not shown). Any other area on the workpiece that is not engaged by the tool piece 42 is known as a non-work area (not shown).

To aid in understanding of the present invention, FIG. 3 illustrates a pneumatic circuit of the present invention. An air compressor (not shown) via a main air supply line (not shown) supplies compressed air to the tool 10 via the main inlet 16, as is known in the art. The compressed air is then communicated to the manifold 18. Then, the compressed air travels to the air blow inlet 22 and the DA inlet 20. Compressed air that enters the air blow inlet 22 then travels through the air blow supply line 26 to the air blow valve 30. A worker (not shown) selectively opens the air blow valve 30 by depressing the actuating button 32. When the actuating button 32 is depressed, the compressed air travels through the air blow valve 30 and is dispensed by the nozzle 34. Alternatively, should the actuator 40 be depressed, the compressed air that enters the DA inlet 20 travels through the entry channel 48 of the housing 28, engages the rotary air vane 50 inside of the housing 28, and is communicated through the exit channel 52 of the housing 28. Finally, the air passes through the exhaust port 54 and, optionally, through the muffler 56.

With reference once again to FIGS. 1-2, the DA sander 12 selectively drives the tool piece 42, and hence the mounting disc 46 and the sandpaper 44, in either a random orbital movement or orbital movement. DA sanders have enjoyed wide commercial success, particularly in the vehicle manufacturing/repair industry, because in the random orbital mode, a very fine finish may be obtained. In addition, when operated in the orbital mode, the DA sander 12 is effective for heavy stock removal, while providing a finish superior to that produced by a typical rotary disc sander. This flexibility in operation of the DA sander 12 is desirable in the vehicle manufacturing/repair industry when painted surfaces must be quickly sanded and/or polished. While the pneumatic tool 10 of the present invention is illustrated as a DA sander 12, it is understood that the tool 10 and related tool piece 42 could instead be, for example, a pneumatic grinder, pneumatic drill, pneumatic file, or pneumatic saw.

The main inlet 16 is illustrated as a quick connect fitting. The quick connect fitting is utilized to allow rapid attachment and detachment of the tool 10 from the main air supply line. The main air supply line has a complimentary fitting for fluid connection to the main inlet 16 of the present invention. Furthermore, as is also known in the art, the quick connect fitting provides for interchangeability between various types of pneumatic tools and the main air supply line.

Attached to the main inlet 16 is the manifold 18. The manifold 18 is generally cylindrical in shape and is hollow to allow fluid communication between the main inlet 16 and the DA inlet 20 and the air blow inlet 22. However, other shapes for the manifold 18 are possible and contemplated. Because of the manifold 18, the DA inlet 20 and the air blow inlet 22 airflows are parallel and operational issues are reduced. In particular, a pressure of about 90 p.s.i. and a flow rate of about 17 s.c.f.m. are supplied to either the tool piece 42 or the nozzle 34. This is in direct contrast to the known tools that supply the components in series or power the air blow device from the exhaust of the tool. The layout of the actuating button 32 of the air blow device 14 and the actuator 40 of the DA sander 12 encourages independent and exclusive operation of the air blow device 14 or the DA sander 12.

As illustrated, the DA inlet 20 axially extends from the manifold 18 on a side opposite that of the main inlet 16. The air blow inlet 22 extends in a vertical direction from the manifold 18 before changing direction to be generally parallel to the manifold 18, having what could be described as a sideways L-shape.

The air blow supply line 26 has a hollow tube-like construction with an inner diameter. The air blow supply line 26 extends in a generally horizontal direction from the air blow inlet 22 and closely follows the curvature of the housing 28 of the DA sander 12, so as to minimize the possibility of the air blow supply line 26 being caught on nearby objects. The inner diameter of the air blow supply line 26 may be increased or decreased to adjust the pressure and flow rate of the air expelled through the nozzle 34.

The air blow valve 30 is L-shaped including the first section 36 and the second section 38. The first section 36 is generally cylindrical and extends in a generally horizontal direction from the air blow supply line 26. The first section 36 is hollow to allow fluid communication between the air blow supply line 26 and the second section 38 of the air blow valve 30. At an end distal to the connection between the air blow supply line 26 and the first section 36, the first section 36 attaches to the second section 38.

The second section 38 vertically extends upward from the first section 36. The actuating button 32 is disposed at an end of the second section 38 distal to the connection between the first section 36 and the second section 38 and is connected to a valve (not shown) disposed in the second section 38 to selectively permit/prevent airflow by depressing/releasing the actuating button 32. Preferably, the actuating button 32 is biased to an undepressed position corresponding to a closed-valve position. The nozzle 34 extends in a horizontal direction from the second section 38. The actuating button 32 allows selective fluid communication between the air blow supply line 26 and the nozzle 34. The air blow valve 30 shown is merely illustrative of a type of fluid control device; any device that allows for fluid control independent of the actuator 40 is possible and contemplated.

The nozzle 34 is of a hollow pipe construction. Although illustrated as having solid walls, it is also contemplated that relief holes would be cut or drilled into the walls of the nozzle 34. This would be especially beneficial to reduce the outlet air pressure when an air pressure of 30 p.s.i. or greater is supplied to the nozzle 34.

Although not illustrated, it is considered apparent the general structure inside of the housing 28 of the DA sander 12 is known in the art. However, for clarity, a brief description of the interior structure will be given. As mentioned hereinbefore, the DA inlet 20 axially extends in a horizontal direction from the manifold 18 on a side opposite that of the main inlet 16. The actuator 40 allows for selective fluid communication between the DA inlet 20 and the entry channel 48. The entry channel 48 is fluidly connected to the rotary air vane 50.

The rotary air vane 50 is axially connected to the tool piece 42. However, the rotary air vane 50 may be connected to the tool piece 42 by any other means that allows rotation of the tool piece 42 when the actuator 40 is depressed and compressed air flows through the rotary air vane 50. The tool piece 42, which in the present example is the sandpaper 44 and the mounting disc 46, is generally circular in shape and has a flat bottom surface for even perpendicular engagement with the workpiece (e.g. the surface that is sanded/polished).

It is noted that the nozzle 34, and the resulting air expelled from the nozzle 34, is in a direction generally perpendicular to the engagement surface of the tool piece 42 with the workpiece. This allows the nozzle 34 to direct compressed air to locations (non-work areas) that are distinct from the work area. For example, the DA sander 12 can be used to polish a vehicle roof (the workpiece), and then compressed air can be released from the nozzle 34 to displace dust/debris from a door hinge area (the non-work area) of a vehicle, without operating the tool piece 42.

After the air has passed through the rotary air vane 50, the air is received in the exit channel 52. The exit channel 52 is fluidly connected to the exhaust port 54. The exhaust port 54 is also fluidly connected to the optional muffler 56 that is axially attached to the exhaust port 54. The muffler 56 is generally cylindrical in shape and may contain baffles or other structures to retard the speed of the air that is dispensed from the exhaust port 54, as is known in the art.

Figure 4:
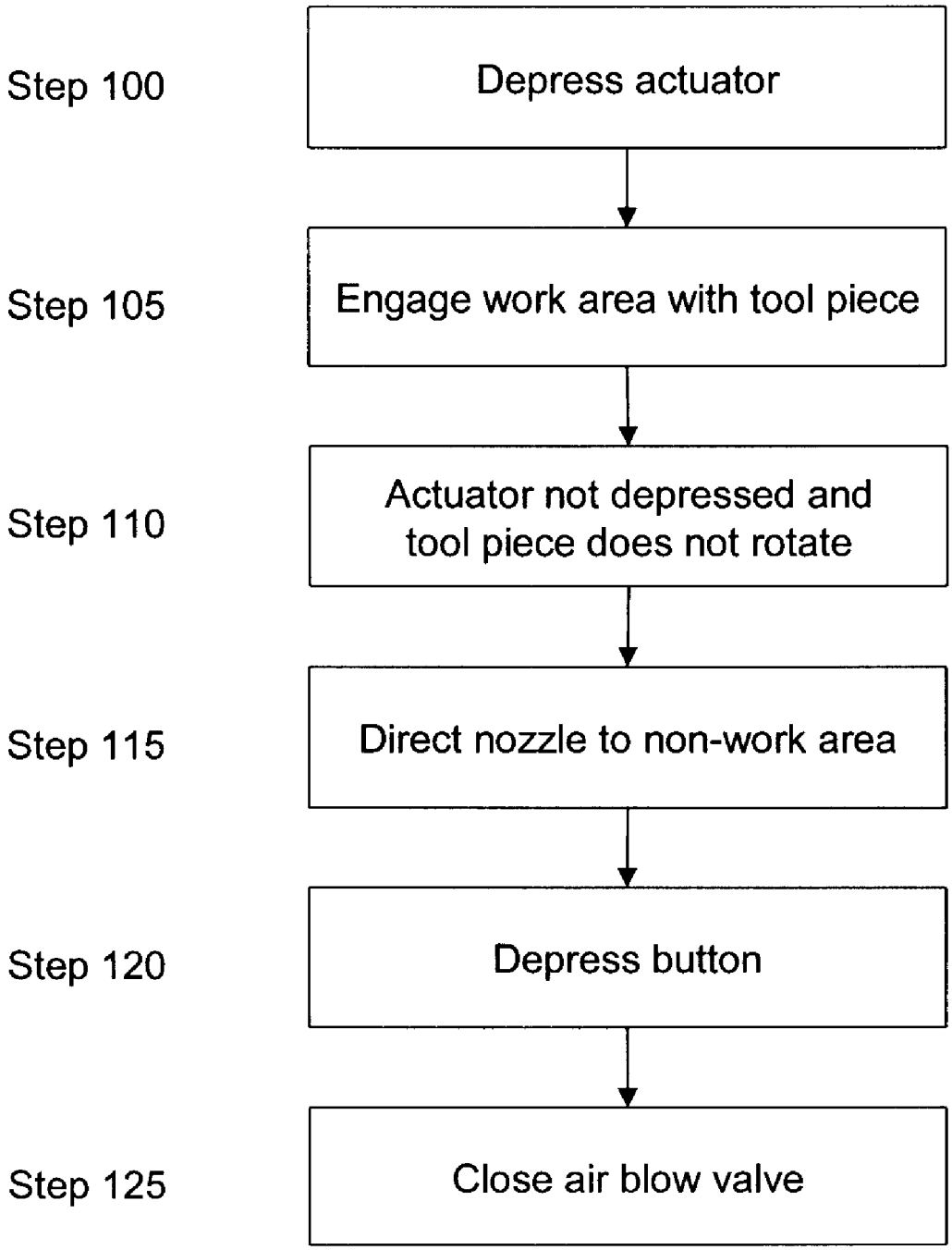
FIG. 4 is a flow chart illustrating steps of a method according to the present invention.

As shown in FIG. 4, a method of using the present invention will now be discussed. It should be noted that it is assumed that the present invention is already attached to the main air supply line and a sufficient pressure and amount of compressed air is being supplied to the tool. Typically, the compressed air has a pressure of about 90 p.s.i. and a flow rate of about 17 s.c.f.m. However, other flow rates and pressures are possible and contemplated. In Step 100, the actuator 40 is depressed by the worker, and the tool piece 42 rotates while the nozzle 34 does not expel compressed air. The tool piece 42 is placed in engagement with the workpiece (Step 105). In Step 110, the actuator 40 is released and the tool piece 42 stops rotating. Then the worker directs the tool 10, and specifically, the nozzle 34 to an area away from the workpiece (i.e., toward the non-work area), and depresses the actuating button 32 of the air blow valve 30 (Steps 115, 120) and thereby directs a stream of pressurized air forward. In Step 125, the worker closes the air blow valve 30 by removing pressure from the actuating button 32 and compressed air stops flowing from the nozzle 34.

The present invention offers numerous benefits over the known pneumatic tools. The present invention provides that the tool piece 42 and the nozzle 34 are intended to be separately operated. In particular, the nozzle 34 selectively expels pressurized air to the non-work area independent of the operation of the tool piece 42. Because of this, dust/debris can be removed without operation of the tool piece 42. Furthermore, because the nozzle 34 is generally perpendicular to the tool piece engaging surface, the nozzle 34 may be directed to blow pressured air to areas with reduced accessibility that would be difficult to reach if the nozzle 34 were parallel to the tool piece engaging surface space. Finally, because the nozzle 34 and the tool piece 42 are powered from the compressed air in the manifold 18 in a parallel arrangement, operational issues such as inadequate air flow or air pressure are reduced. This layout of the actuating button 32 and the actuator 40 promotes independent operation of the air blow device 14 and the DA sander 12.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A pneumatic tool that is powered by compressed air, for working on a workpiece and removing debris from the workpiece, comprising:

a tool piece that performs work on a work area of the workpiece, wherein said tool piece defines a rotary axis that perpendicularly extends from a mounting disc; and an air blow device that directs the compressed air to a non-work area of the workpiece to remove debris from the non-work area, the air blow device including an air blow inlet fluidly connected to a manifold and an air blow supply line, wherein the manifold is supplied the compressed air from a main inlet, and wherein the air blow supply line fluidly connects the air blow inlet and an air blow valve with an actuating button, and the actuating button allows selective fluid communication between the air blow supply line and a nozzle of straight hollow pipe construction that expels the compressed air toward the non-work area, wherein the nozzle is generally perpendicular to the rotary axis of the tool piece, and the air blow device operates independently of the tool piece.

2. The pneumatic tool of claim 1, wherein the tool is a dual action disc sander that further comprises sandpaper.

3. The pneumatic tool of claim 1, wherein a layout of the tool piece and the air blow device provide for independent operation of the tool piece and the air blow device.

4. The pneumatic tool of claim 1, wherein the tool is a dual action (DA) disc sander and further comprises:

a dual action inlet fluidly connected to the manifold and a dual action supply line;

the dual action supply line fluidly connects the dual action inlet and an actuator for the tool piece; and the actuator allows selective fluid communication between the dual action supply line and a rotary air vane, wherein the compressed air rotates the rotary air vane that rotates the tool piece.

5. A pneumatic tool that is powered by compressed air, for working on a work area of a workpiece and removing debris from a non-work area of the workpiece, comprising:

an air blow device with a nozzle of straight hollow pipe construction that expels the compressed air toward the non-work area to remove debris, the air blow device including an air blow inlet fluidly connected to a manifold and an air blow supply line, wherein the manifold is supplied the compressed air from a main inlet, and the air blow supply line fluidly connects the air blow inlet and an air blow valve with an actuating button, and the actuating button allows selective fluid communication between the air blow supply line and the nozzle; and a tool piece that defines a rotary axis that perpendicularly extends from a mounting disc and that performs work on the work area of the workpiece, wherein the nozzle is generally perpendicular to the rotary axis of the tool piece and the tool piece engages the work area of the workpiece in a direction that is generally perpendicular to the nozzle, wherein the air blow device is independent of the tool piece, and the work area and the non-work area are two different locations.

6. The pneumatic tool of claim 5, wherein the tool piece further comprises sandpaper.

7. The pneumatic tool of claim 5, wherein a layout of the tool piece and the air blow device provides for independent operation of the tool piece and the air blow device.

8. The pneumatic tool of claim 5, wherein the tool is a dual action (DA) disc sander and further comprises:

a dual action inlet fluidly connected to the manifold and a dual action supply line;

the dual action supply line fluidly connects the dual action inlet and an actuator for the tool piece; and the actuator allows selective fluid communication between the dual action supply line and a rotary air vane, wherein the compressed air rotates the rotary air vane that rotates the tool piece.

9. A method for working a work area of a workpiece and removing debris with a pneumatic tool that includes a tool piece for working the work area and an air blow device with a nozzle and an actuating button for removing debris from a non-work area of the workpiece, comprising the steps of:

depressing an actuator to supply compressed air to the tool piece, wherein the tool piece defines a rotary axis that perpendicularly extends from a mounting disc;

engaging the work area with the tool piece;

releasing the actuator to stop engagement of the work area with the tool piece;

directing the nozzle of straight hollow pipe construction that is generally perpendicular to the rotary axis of the tool piece toward the non-work area, wherein the non-work area is different than the work area; and depressing the actuating button to expel compressed air from the nozzle.

10. The method for working the work area and removing the debris according to claim 9, wherein the steps of expelling the compressed air and driving the tool piece do not occur at a same time.

11. The method for working the work area and removing the debris according to claim 9, wherein the work area and the non-work area are two different locations.

12. A dual action (DA) disc sander that is powered by compressed air, for working on a work area of a workpiece and removing debris from a non-work area of the workpiece, said work area and non-work area are different locations on the workpiece, the dual action (DA) disc sander comprising:

a tool piece that performs work on the work area, wherein said tool piece defines a rotary axis that perpendicularly extends from a mounting disc;

an air blow device that is independent of the tool piece and directs the compressed air toward the non-work area to remove the debris, the air blow device comprising:

a nozzle of straight hollow pipe construction that expels the compressed air toward the non-work area, wherein the nozzle is generally perpendicular to the rotary axis of the tool piece, an air blow inlet is fluidly connected to a manifold and an air blow supply line, wherein the manifold is supplied the compressed air from a main inlet and the air blow supply line fluidly connects the air blow inlet and an air blow valve with an actuating button, and the actuating button allows selective fluid communication between the air blow supply line and the nozzle;

a dual action inlet is fluidly connected to the manifold and a dual action supply line, wherein the dual action supply line fluidly connects the dual action inlet and an actuator for the tool piece; and the actuator allows selective fluid communication between the dual action supply line and a rotary air vane that rotates the tool piece.

13. The dual action (DA) disc sander of claim 12, wherein sandpaper is attached to the mounting disc.

* * * * *